US009649535B2

(12) United States Patent
Nicol

(10) Patent No.: US 9,649,535 B2
(45) Date of Patent: May 16, 2017

(54) LOWER LEG AND BOOT SWIMMING FIN SYSTEM

(71) Applicant: William Nicol, Kennewick, WA (US)

(72) Inventor: William Nicol, Kennewick, WA (US)

( * ) Notice: Subject to any disclaimer, the term of this patent is extended or adjusted under 35 U.S.C. 154(b) by 0 days.

(21) Appl. No.: 14/604,835

(22) Filed: Jan. 26, 2015

(65) Prior Publication Data

US 2016/0213982 A1 Jul. 28, 2016

(51) Int. Cl.
*A63B 31/11* (2006.01)
*A63B 31/12* (2006.01)

(52) U.S. Cl.
CPC ..... *A63B 31/12* (2013.01); *A63B 31/11* (2013.01); *A63B 2209/10* (2013.01)

(58) Field of Classification Search
CPC ... A63B 2031/112; A63B 31/11; A63B 31/10; A63B 31/08
USPC ..... 441/59–63
See application file for complete search history.

(56) References Cited

U.S. PATENT DOCUMENTS 320,762 A * 6/1885 Couper ..... A63B 31/14 441/63
689,085 A * 12/1901 Hooper ..... A63B 31/14 441/59

* cited by examiner

*Primary Examiner* — Andrew Polay
(74) *Attorney, Agent, or Firm* — Global Intellectual Property Agency, LLC; Daniel Boudwin

(57) ABSTRACT

Provided is a swimming fin system that includes a boot portion and a lower leg portion for improved swimming efficiency and normal ambulation over dry land. The lower leg portion comprises a substantially cylindrical sleeve configured to receive the lower leg of a wearer and support a pair of laterally extending fin members. The fin members are substantially rectangular and do not overlap the swimmer's ankle or foot. Each boot portion receives the foot and heel of the wearer, while supporting a pair of substantially rectangular fin members that extend from the lateral sides of the boot. The fins do not extend substantially beyond the toes of the wearer. While donned, the fins of the boot and lower leg portions can be angled relative to one another during kicking motions, while the fins of the boot portions do not interfere with a user's gait over dry land.

7 Claims, 5 Drawing Sheets

LOWER LEG AND BOOT SWIMMING FIN SYSTEM

BACKGROUND OF THE INVENTION

Field of the Invention

The present invention relates to swimming fin devices and wearable structures that assist a wearer propelling himself through water. More specifically, the present invention discloses a wearable fin system that includes a lower leg portion and a boot portion that support substantially rectangular fins that allow a user to walk with the fins on and propel the user during a kicking motion while swimming.

Swimming fins are common articles in the art of diving and open water swimming. These articles are generally boot-worm appliances that extend the surface area of the wearer's foot to assist the user when submerged and propelling one's self through the water. The fins are typically flexible extensions that can be moved in an upward and downward motion to power the wearer in a forward direction with greater velocity than possible otherwise. The flexibility and enlarged surface area of the fins improves swimming efficiency, whereby the physical output of the swimmer is reduced while speed can be improved. The surface area of the fins displaces larger quantities of fluid as the swimmer kicks, creating greater propulsion from each kicking stroke that possible by the user's feet alone.

Common civilian applications include leisure snorkel swimming and underwater diving with a breathing apparatus. Military applications include various underwater operations in which speed or swimming efficiency is desired, including covert swimming operations or instances that require traversing large bodies of water. While swim fins are common devices in the art of diving, their design has inherent drawbacks that can be improved upon. Swimming fins are generally provided only affixed to a wearable boot, therefore its surface area is limited to the degree in which walking is inhibited or would be practical to support along the end of the wearer's foot. Potential fin placement along the rest of the user's legs is not capitalized upon, which otherwise would improve propulsion efficiency and power of the swimmer. Finally, as mentioned, walking on dry land is considerably hampered using traditionally elongated swimming fins, which extend well beyond the extent of the wearer's toes and prevent normal walking.

These drawbacks are addressed by the swimming fin system of the present invention. The fin system of the present invention includes a lower leg portion and a boot portion, whereby substantially rectangular fin members extend from the sides thereof to provide an elongated, split fin system that extends from the wearer's knees to the end of the wearer's feet. The lower leg portion extends from the knee to the ankle and includes a cylindrical body portion that secures to the leg of the wearer. The boot portion comprises a foot mold and secures around the heel and around foot of the wearer. Rectangular fin portions extend from the sides of the boot portion and do not extend substantially beyond the toes of the wearer. This combination of lower leg and boot fin provides increased fin surface area, a break in the fin to allow the boot fins to articulate relative to the lower leg fins, while also providing a boot configuration that allows for normal walking on dry land over traditionally elongated fin members.

Description of the Prior Art

Devices have been disclosed in the prior art that relate to swimming fins for a user's legs and feet. These include devices that have been patented and published in patent application publications. The following is a list of devices deemed most relevant to the present disclosure, which are herein described for the purposes of highlighting and differentiating the unique aspects of the present invention, and further highlighting the drawbacks existing in the prior art.

One such device in the prior art is U.S. Pat. No. 5,338,235 to Lee, which discloses a swimming aid that includes a fin that is flexibly affixed at one end to the shin of a wearer and allowed to pivot from its connection with the shin of the wearer. A pair of straps supports a shin piece that is disposed over the shin, while the fin is flexibly attached to the upper portion of the shin piece. When the user kicks his or her leg, the fin articulates about its flexible connection to assist the user in the leg downswing, and to reduce drag on the upswing. While providing a fin connected to the lower leg of the user, the Lee device provides an articulating fin assembly that moves relative to the shin of the swimmer. The present invention provides static fin members along the lateral sides of the wearer's lower leg that do not move during a kicking motion.

Another device is U.S. Patent Publication No. 2012/0252289 to Johnson, which discloses a swim fin that is similarly affixable to the shin of a wearer. The device comprises a frame supported by an upper attachment and a lower attachment to the wearer. The frame supports a plurality of louvered blades that assist the user during a kicking stroke in the water. The louvers are semi-rigid blades separated by gaps and backed up by a flexible surface. The louvers blades allow water to flow through the frame in operation. The Johnson device comprises an offset, louvered surface relative to the shin of the wearer. Similar to Lee, Johnson fails to anticipate the lower leg portion of the present invention.

U.S. Pat. No. 7,040,942 to Houck discloses a swim fin that comprises a shin sleeve with a pair of angled fins extending therefrom. The device comprises a shin sleeve that can be affixed to the wearer's shin between the knee and ankle, while a pair of fins is affixed within channels and extend away from the sleeve in a triangular flange configuration. The channels allow the fins to move relative to the sleeve along the wearer's lower leg, upwardly and downwardly during leg movements. Houck provides movable fin members along the lower leg of the user. The present invention contemplates static, substantially rectangular fin portions.

U.S. Pat. No. 1,059,443 to Cseki discloses another swimming device in which a blade is hinged to a leg piece affixable to a wearer's lower leg. The blade is hinged attached to the leg piece along its interior edge, whereby the blade can pivot relative to the leg piece during forward and backward movement of the leg. The hinged fin portions of Cseki fail to anticipate the rigid inner and outer rectangular fin portions of the present invention.

U.S. Pat. No. 3,015,829 to Gronkowski discloses an apparatus for a swimmer that comprises a wearable set of inflatable fin members that are securable along the arms and legs of a wearer. The inflatable members are co-extensive with the length of the arm or leg of the wearer, and provide triangular projections that assist the propelling power of the wearer in the water.

Finally, U.S. Pat. No. 8,246,404 to Sweet discloses a foot worn swim fin that includes a leg portion and a boot portion and a first and second fin extending therefrom. The first fin is disposed along the leg portion, and the second fin is disposed along the boot. The leg portion and boot portion are both worn to provide a fin extending from the knee to the ankle, and then from the ankle to the toes of the wearer. While the swim fins of Sweet provides a boot portion and a lower leg portion, the lower leg portion of Sweet is one that terminates along the foot of the wearer. The lower edge of the leg fin is oblique to the upper fin portion, whereby overlap of the boot fin and the leg portion fins is facilitated. The Sweet device teaches away from the present invention in that the present invention contemplates a pair of rectangular fins that terminate at the lower edge of the lower leg portion, and do not overlap onto the boot fin portions.

The present invention therefore provides a lower leg fin member and a boot fin member that are aligned when the user aligns his foot with his lower leg during a plantar flexion movement. The fins of the lower leg portion do not overlap the fins of the boot portion, whereby both are substantially rectangular, rigid members that extend from the lateral sides of both portions.

Overall, the present invention is substantially divergent in design elements from the prior art, and consequently it is clear that there is a need in the art for an improvement to existing swimming fin devices. In this regard the instant invention substantially fulfills these needs.

SUMMARY OF THE INVENTION

In view of the foregoing disadvantages inherent in the known types of swimming fin devices now present in the prior art, the present invention provides a new swimming fin system that can be utilized for providing convenience for the user when improving swimming efficiency while also allowing for normal dry land walking while the fins are donned.

It is therefore an object of the present invention to provide a new and improved swimming fin system that has all of the advantages of the prior art and none of the disadvantages.

It is another object of the present invention to provide a swimming fin system comprising a separable boot portion and a lower leg portion, each portion supporting laterally extending and substantially rectangular fin members.

Another object of the present invention is to provide a swimming fin system in which fin surface area is provided along the lower leg and foot region of the user, while being disposed along the interior and exterior sides of the user's legs and feet.

Yet another object of the present invention is to provide a swimming fin lower leg portion that comprises a pair of rectangular fin members extending from the lateral sides of the portion, whereby the fin members do not interfere with articulation of the wearer's ankle or foot during swimming motions.

Another object of the present invention is to provide a swimming fin boot portion that includes laterally extending and rectangular fin members along the sides of a boot that receives the wearer's foot, whereby the fin members extends around the front of the boot portion but do not extend substantially beyond the toes of the wearer such that a normal gait and normal ambulation across dry land would be inhibited.

Another object of the present invention is to provide a swimming fin system that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
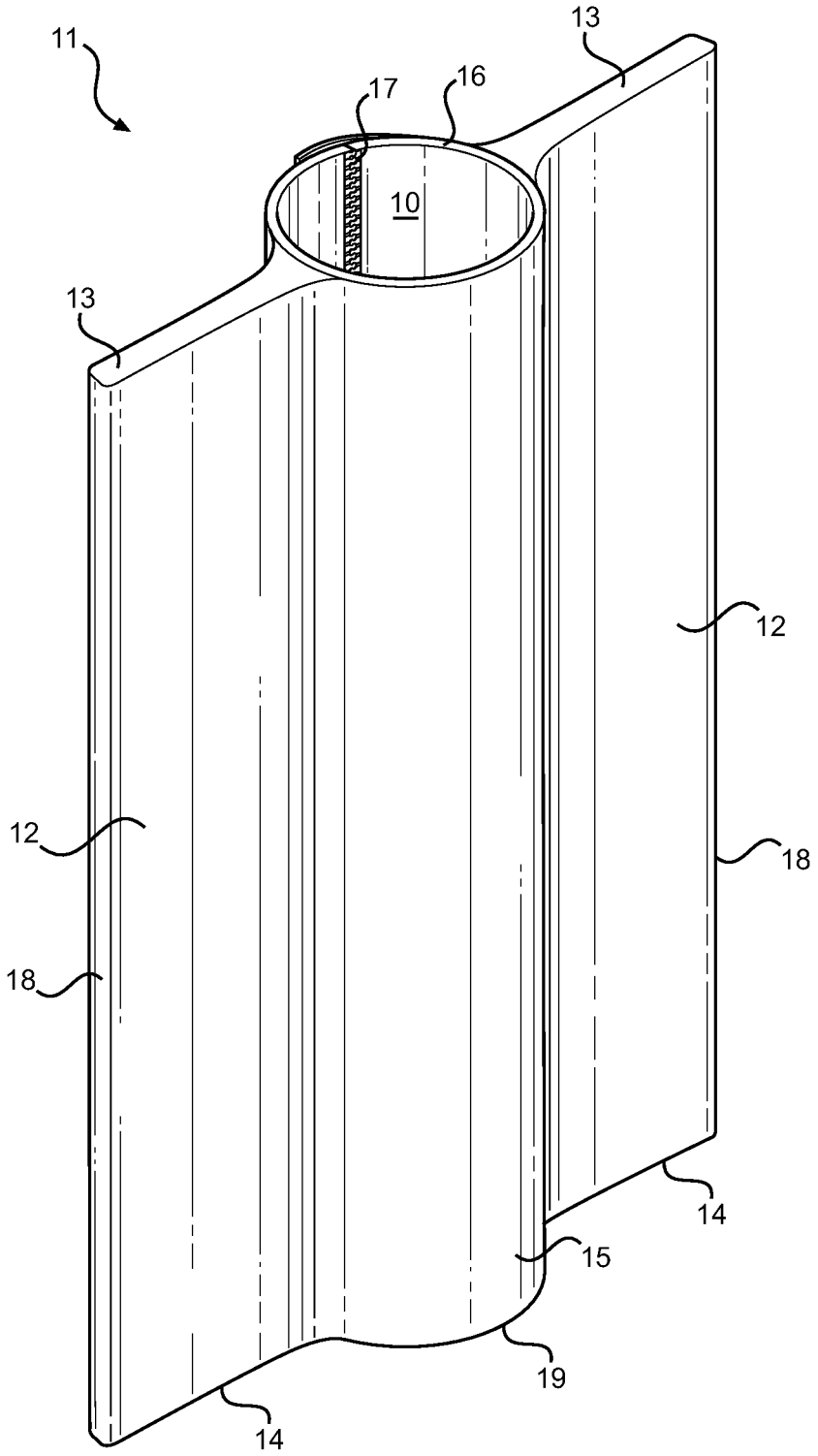
FIG. 1 shows a perspective view of the lower leg portion of the swimming fin system of the present invention.

Reference is made herein to the attached drawings. Like reference numerals are used throughout the drawings to depict like or similar elements of the swimming fin system of the present invention. For the purposes of presenting a brief and clear description of the present invention, the preferred embodiment will be discussed as used for improving swimming efficiency and for permitting normal ambulation while the fin system is donned over dry land. The figures are intended for representative purposes only and should not be considered to be limiting in any respect.

Figure 2:
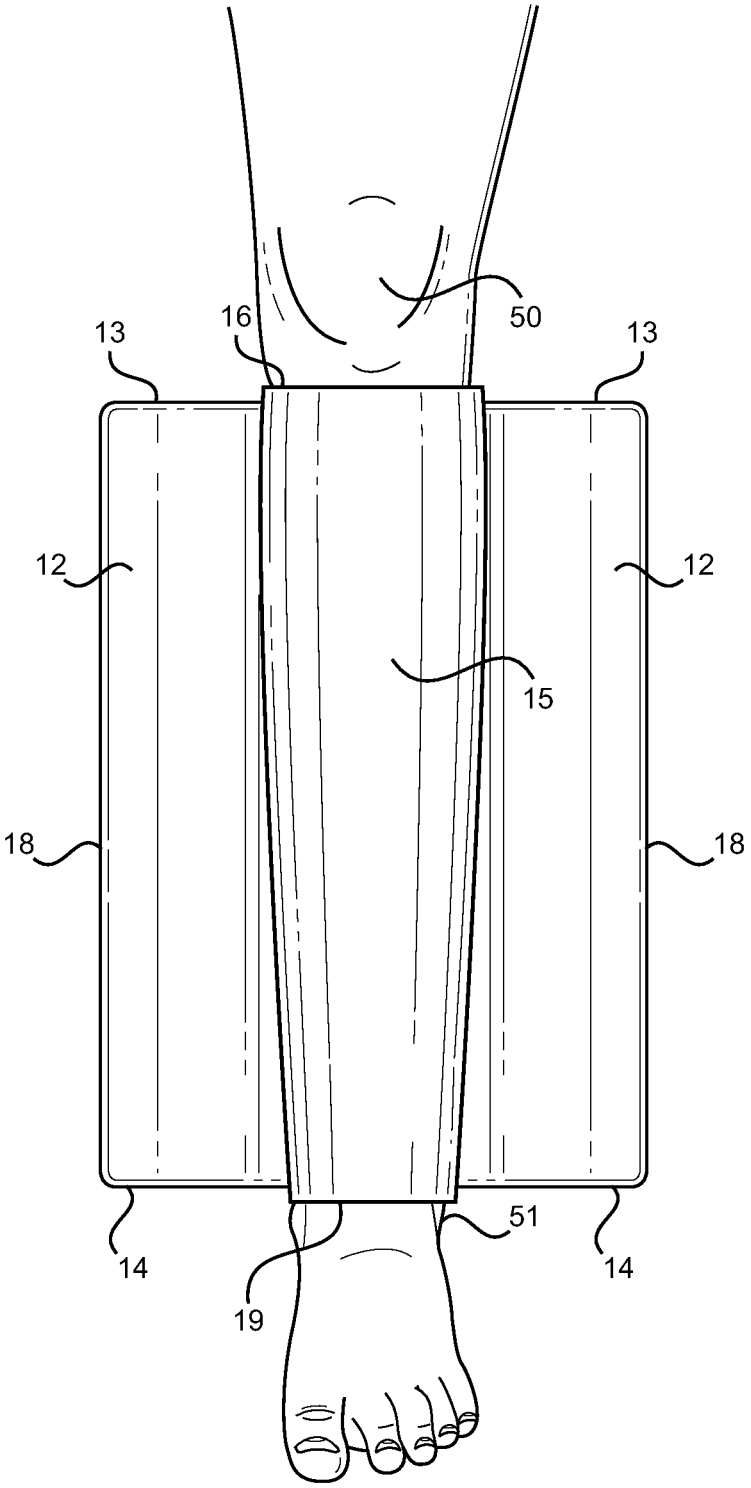
FIG. 2 shows a frontal view of the lower leg portion.

Referring now to FIGS. 1 and 2, there are shown two views of the lower leg portion 11 of the swimming fin system. The lower leg portion 11 comprises a substantially cylindrical sleeve 15 with an open interior 10 that is configured to receive the lower leg of the user and be positioned between the knee 50 and ankle 51 thereof. The sleeve 15 forms the body of the lower leg portion 11 and extends around the outer surface of the user's calf and shin. Along the lateral sides of the sleeve 15 is a first and second fin member 12 directly affixed thereto, such that each of the first and second fin members 12 are in immediate physical contact with the sleeve 12. The fin members 12 are substantially rectangular structures that extend outward from the lateral sides of the sleeve 15.

The fin members 12 are substantially rigid and comprise three exposed edges: an upper edge 13, and outer edge 18, and a lower edge 14. The fin members 12 secure to the sleeve 15 along an inner edge, while the overall length of the fin members 12 is substantially equal to the length of the sleeve 15, thereby providing an inner and outer fin member 12 along the length of the user's lower leg. The length extends from the upper edge 13 to the lower edge 14, while the width of the fins extends from the lateral sides of the sleeve 15 to the outer edge 18. The fins are substantially rectangular and do not extend above the upper edge 16 of the sleeve, or below the lower edge 19 thereof. In this manner, the rectangular fins do not cover the knee 50 or ankle 51 of the wearer, and do not interfere with any foot-worn fins. The lower leg portion 11 furthermore does not interfere with normal articulation of the knee 50 or ankle 51 while swimming.

Figure 3:
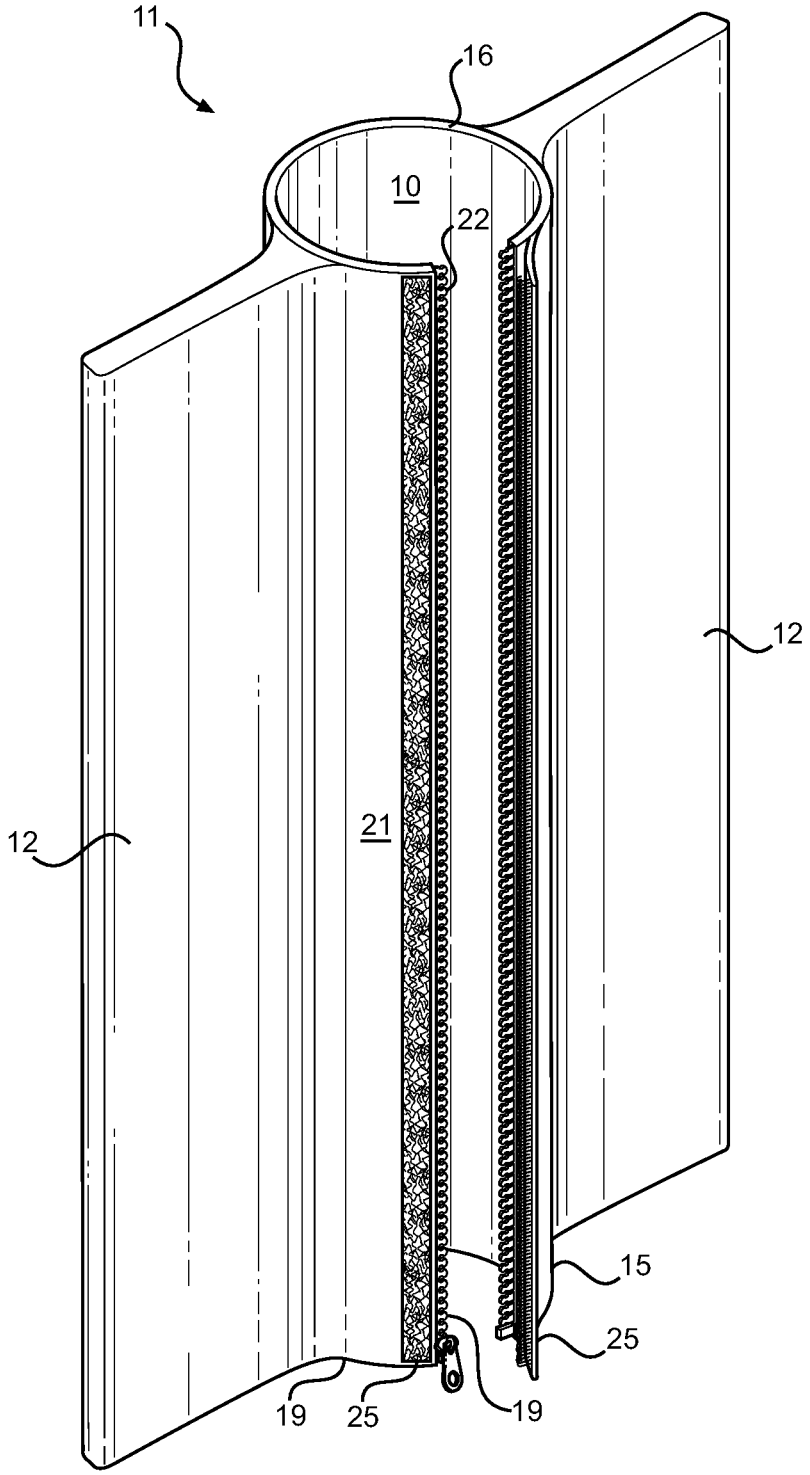
FIG. 3 shows a rear perspective view of the lower leg portion and an embodiment that is separable along its rear surface.

To secure the lower leg portion 11 to the user's leg, the sleeve 15 is either slid thereover, or a separable line of connection 17 is provided along the rear surface of the sleeve 15. Referring now to FIG. 3, there is shown a perspective view of the rear surface 21 of the sleeve 15. In one embodiment, the sleeve 15 comprises a continuous surface forming a cylindrical member with an open upper and an open lower end to permit the user to insert his or her foot and lower leg into the interior 10 of the sleeve. In another embodiment, and as presented in FIG. 3, there rear surface 21 of the sleeve comprises a separable line of the connection 17.

The line of connection 17 allows the sleeve 15 to be opened from the rear surface 21 and reattached along the line of connection 17 after the user has inserted his or her lower leg into the interior 10 of the sleeve 15. The line of connection 17 comprises an elongated fastener extending therealong, whereby the fastener may comprises a zip fastener 22, an elongated strip of hook and loop fasteners 25, or similar attachment fastener that secures the line of connection 17 together along the rear of the user's lower leg.

The sleeve material is preferably a resilient yet elastic material that conforms to the lower leg of the user. This may comprises a rubber material or a neoprene, or any similar material that does not readily tear or fray, yet is elastic and conforms to the user's lower leg. The material may further comprise an insulated material or a material with sufficient thickness to keep the user's legs warm. The material is one that may be drawn from the art of swim fins, dive suits, and wet suits in the art, falling within the scope of the claimed invention. The fin members 12 are preferably a more rigid material that does not bend during rigorous kicking motions. The fin members 12 displace water as the user kicks his or her legs in the water during a swimming motion, therefore the fins 12 must not be overly elastic or bend during such usage.

Figure 4:
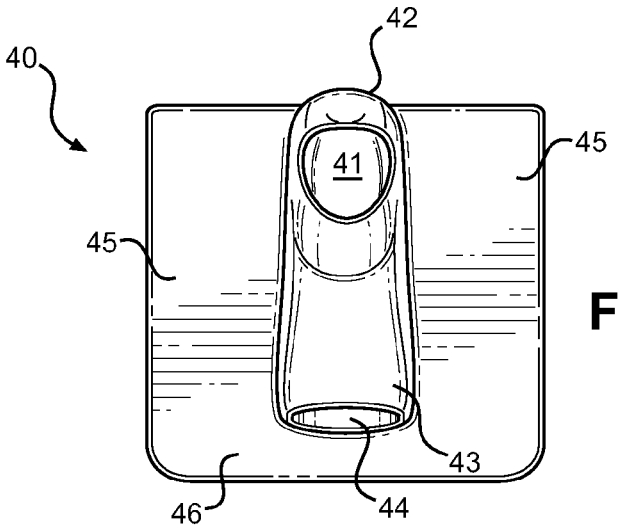
FIG. 4 shows an overhead view of the boot portion of the present invention.

Referring now to FIG. 4, there is shown an overhead view of the boot portion 40 of the present invention. The boot portion 40 comprises a boot mold that is configured to secure over the foot of the wearer and around the heel thereof. The boot mold comprises a metatarsal upper portion 43 and a heel rear region 42, whereby the upper portion 43 secures over and around the user's foot, while the heel portion 42 secures around the rear of the user's heel. This secures the boot portion 40 to the user's foot when the foot is positioned through the interior 41 of the boot mold. The forward end 44 of the boot mold may be exposed to allow the user's toes to extend therethrough, or alternatively the forward end 44 may be enclosed.

The boot portion 40 further comprises laterally extending fin members 45 that extend from the lateral sides of the boot mold. The fin members 45 are directly affixed to the boot mold, such that the fin members 45 are in immediate physical contact with the boot portion 40. The fin members 45 are substantially rectangular surfaces and share a similar construction as the fin members of the lower leg portion. The fin members 45 of the boot portion 40 extend along the length of the boot mold and the user's foot, and do not extend substantially beyond the forward end 44 of the boot mold. Therefore, the fin members 45 do not extend substantially beyond the toes of the user, and therefore do not interfere with normal ambulation over dry land as compared to traditionally elongated swim fins.

Figure 5A:
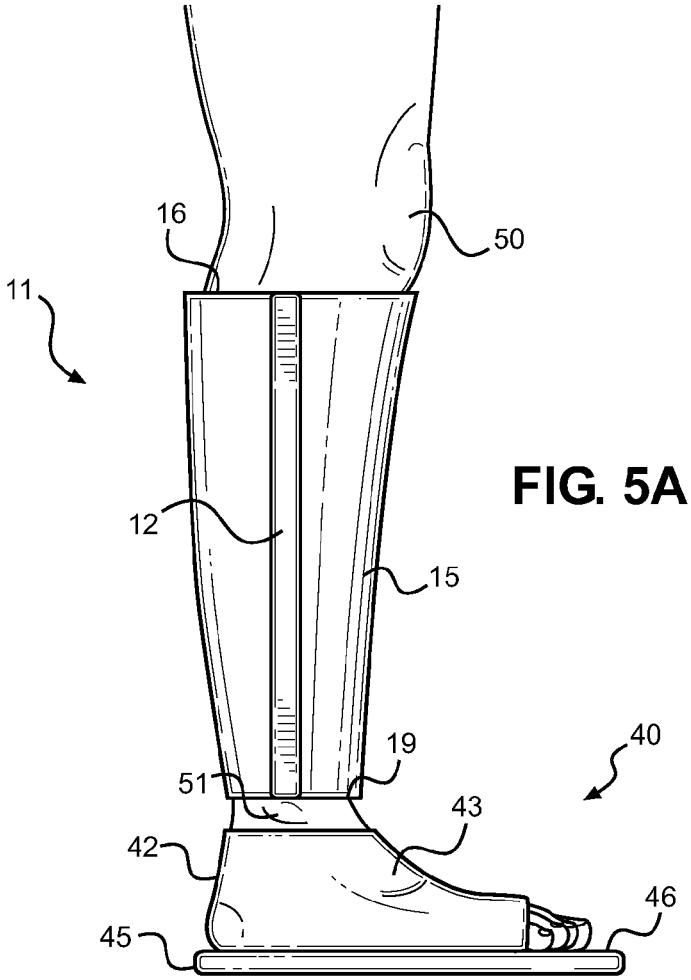
FIG. 5A shows a side view of the lower leg portion and the boot portion donned by the wearer.
Figure 5B:
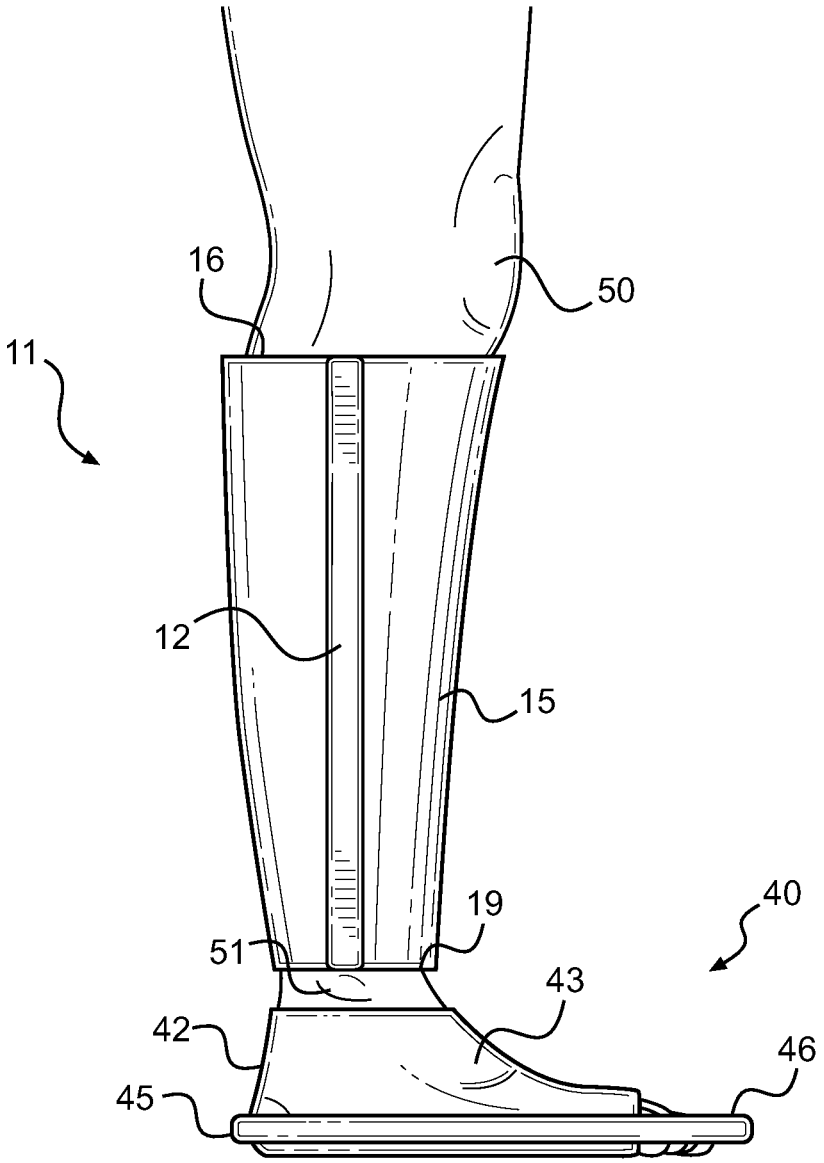
FIG. 5B shows another side view of the lower leg portion and the boot portion donned by the wearer.

Referring now to FIGS. 5A and 5B, there are shown two side views of the boot and leg portions of the swimming fin system of the present invention. The fins 45 of the boot portion 40 extend from the lateral sides of the boot mold. The fins 45 are disposed below the boot mold (FIG. 5A) or are aligned with the user's foot within the boot mold (FIG. 5B). The lower surface of the boot mold in the latter embodiment extends below the lower surface of the fins 45, thereby improving walking while the boot portion 40 is donned over dry land.

When donned, the lower leg portion 11 and the boot portion 40 do not interfere with one another along the leg and foot of the wearer. The lower leg portion 11 extends between the knees 50 and ankle 51, while the boot portion 40 covers the foot and heel of the user. The ankle 51 and knee 50 are free to rotate freely, thereby allowing the user to flex his or her ankle 51 to best position the fins 45 of the boot portion 40 relative to the fins 12 of the lower leg portion 11 during swimming motions. Furthermore, the shortened length 46 of the boot portion fins 45 allow the user to more easily walk across dry land when the user transitions from land to water, or vice versa.

The boot portion 40 includes a boot mold that has a metatarsal upper region 43 securing over the length of the user's foot, along with a heel portion 42 that secures around the heel of the user. The heel portion 42 may furthermore be open and include a fastener therearound, if so desired and to accommodate larger feet with a more adjustable boot mold. The fins 45 are below or in line with the boot mold, and extend laterally therefrom to provide an increased surface area. Similarly, the fins 12 of the lower leg portion 11 extend from the upper edge 16 to the lower edge 19 of the sleeve 15, and extend laterally therefrom. The fins of both the lower leg portion 11 and the boot portion 40 are substantially rectangular and are configured to increase swimming efficiency by increasing the surface area of the user's legs while swimming.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A swimming fin system, comprising:

a lower leg portion comprising a cylindrical sleeve including a pair of opposing lateral sides and an open interior sized to receive a lower leg therein, the cylindrical sleeve including a continuous surface;

a rectangular lower leg fin member affixed to each of the lateral sides of the lower leg portion, the rectangular lower leg fin members extending along a longitudinal length of the cylindrical sleeve;

wherein the length of the lower leg portion is sized to fit below a user's knee and above a user's ankle;

a boot portion comprising a boot mold including an open interior sized to receive a foot therein, a boot upper region including a pair of opposing lateral sides, a forward end, and a lower surface; and a rectangular boot fin member affixed to each of the lateral sides of the boot mold such that the boot fin members are disposed above the lower surface of the boot mold, the rectangular boot fin member extending outwardly from the boot mold and along a longitudinal length of the boot mold;

wherein the rectangular boot fin member extends past the forward end of the boot mold.

2. The swimming fin system of claim 1, wherein the lower leg portion includes a separable line of connection disposed on a rear surface thereof.

3. The swimming fin system of claim 2, wherein the line of connection includes a fastener configured to operably secure the line of connection together and facilitate separation thereof.

4. A swimming fin system, comprising:

a lower leg portion comprising a cylindrical sleeve including a pair of opposing lateral sides and an open interior sized to receive a lower leg therein, the cylindrical sleeve including a continuous surface;

a rectangular lower leg fin member extending outwardly from each of the lateral sides of the cylindrical sleeve and extending along a longitudinal length of the cylindrical sleeve;

wherein the lower leg fin members are aligned symmetrically relative to each other about a longitudinal plane of the cylindrical sleeve, the longitudinal plane extending through the open interior of the cylindrical sleeve;

wherein the length of the lower leg portion is sized to fit below a user's knee and above a user's ankle.

5. The swimming fin system of claim 4, wherein the lower leg portion-includes a separable line of connection disposed on a rear surface thereof.

6. The swimming fin system of claim 5, wherein the line of connection includes a fastener configured to operably secure the line of connection together and facilitate separation thereof.

7. A swimming fin system, comprising:

a boot portion comprising a boot mold including an open interior sized to receive a foot therein, a boot upper region including a pair of opposing lateral sides, a forward end, and a lower surface; and a rectangular boot fin member extending outwardly from the boot mold and extending along a longitudinal length of the boot mold;

wherein the rectangular boot fin member extends past the forward end of the boot mold;

wherein the boot fin members are affixed to each of the lateral sides of the boot mold such that the boot fin members are disposed above the lower surface of the boot mold.

* * * * *